US005924362A

United States Patent [19]

Volz et al.

[11] Patent Number: 5,924,362

[45] Date of Patent: Jul. 20, 1999

[54] DRIVE FOR A PRINTING MACHINE

[75] Inventors: Albrecht Volz, Rodermark; Joachim Blumor, Hainburg; Holger Wiese, Obertshausen; Klaus-Peter Reichardt, Vilbel, all of Germany

[73] Assignee: MAN Roland Druckmaschinen AG, Germany

[21] Appl. No.: 08/872,847

[22] Filed: Jun. 11, 1997

[30] Foreign Application Priority Data

Jun. 11, 1996 [DE] Germany ..... 196 23 223

[51] Int. Cl.[6] ..... B41F 5/02

[52] U.S. Cl. ..... 101/183; 101/484; 101/216; 101/248

[58] Field of Search ..... 101/181, 183, 101/216, 248, 180, 177, 136, 137, 138, 139, 140, 179, 229, 230, 231, 232, 233, 484

[56] References Cited

U.S. PATENT DOCUMENTS

| | | | |
|---|---|---|---|
| 5,309,834 | 5/1994 | Koch | 101/248 |
| 5,481,971 | 1/1996 | Grutzmacher et al. | 101/183 |
| 5,596,931 | 1/1997 | Rossler et al. | 101/484 |
| 5,615,609 | 4/1997 | Hill et al. | 101/183 |
| 5,682,818 | 11/1997 | Braun et al. | 101/248 |

FOREIGN PATENT DOCUMENTS

| | | |
|---|---|---|
| 4137979 | 5/1993 | Germany . |
| 4214394 | 11/1993 | Germany . |
| 4215227 | 7/1996 | Germany . |

*Primary Examiner*—Christopher A. Bennett
*Attorney, Agent, or Firm*—Leydig, Voit & Mayer, LTD.

[57] ABSTRACT

A drive system for a sheet-fed offset printing press in which one or more cylinders are motor-driven in accordance with a prescribed desired position. According to the invention, a correction device receives measured angular position values of the cylinder from a rotational position sensor. The correction device then converts the measured position values into modified position values which are then sent to the drive controller. The drive controller compares the modified position values with desired cylinder position values and controls the motor so as to correct any deviation between the values. The correction device allows modification of the measured signals as needed to compensate for known or determinable parameters. A drive according to the present invention provides precise driving control, while reducing the required assembly and manufacturing accuracy of components such as the angle position sensor, and while compensating for other errors in drives.

9 Claims, 8 Drawing Sheets

DRIVE FOR A PRINTING MACHINE

FIELD OF THE INVENTION

The invention relates to a drive for a sheet-fed printing machine, and more particularly to a drive having a control system for correcting position errors in the driven elements.

BACKGROUND OF THE INVENTION

Sheet-fed offset printing presses commonly utilize printing unit cylinders together with sheet transport rollers arranged between the printing units. These printing cylinders and transport rollers are typically driven by a continuous gear train with one or more drive motors. In order to achieve accurate printing, the gears of such a conventional gear train must be manufactured with very high precision.

Of course, manufacturing components at very low tolerances is expensive. This expense is substantial for printing presses, because of the numerous components, especially in the context of multiple printing cylinders driven by a continuous drive train.

Drive train elements conventionally requiring precision manufacture are circumferential and lateral registers and the adjusting devices required for correcting them. In order to correct a circumferential and/or lateral register, the plate cylinder is mounted such that it can be adjusted in the circumferential and/or lateral register direction (to the axial direction of the cylinder) with respect to the frame walls supporting it, and can also be adjusted with respect to the gear wheel supporting it. Also, in printing presses having helically toothed gears displacing the plate cylinder gear wheel relative to a blanket cylinder gear wheel driving it, simultaneously causing the plate cylinder gear wheel to rotate, additional correcting devices are also required.

Because of the foregoing reasons, developments have led to the individual driving of the cylinders and drums in sheet-fed offset printing presses by means of individual drives or combined in gear train groups. In this regard, Japanese patent publication JP-A-56-21860 discloses a drive for the cylinders of an offset printing unit, with the plate cylinder, the blanket cylinder and the impression cylinder respectively having individual motors. For the purpose of achieving angular synchronism, these individual drives follow commonly stipulated signals from an electronic control axle. Still, the individual cylinders of such an offset printing unit must be mutually driven with highly accurate angular synchronism. Accordingly, it is necessary to suppress interference or compensate for it. Deviations from synchronization occur due to different mass distribution among the printing unit cylinders. Specifically, this is due to periodically fluctuating loads as the cylinders roll against one another, and due to possible axial alignment errors between the motor and cylinder axis. Devices for compensating or for suppressing such interference are not provided.

German patent publication DE 4 137 979 Al discloses a drive for a printing press having multiple printing units in which the individual printing units or printing unit groups are mechanically decoupled from one another. Each printing unit or each printing unit group has a respective a drive motor and a device for determining rotational speed and/or angle of rotation. For achieving angular synchronism of these printing units or printing unit groups, angle controllers are provided which adjust a permissible deviation of the angle of rotation from a prescribed desired angular value, such that a deviation in the angle of rotation is minimal for the angle of rotation at which sheet transfer is performed. The aim of this device is particularly to avoid irregularities in sheet transfer from one printing unit to a neighboring printing unit or from one printing unit group to a neighboring printing unit group, something which otherwise leads to undesirable ghosting effects and color shifts which adversely affect print quality. Consequently, angular differences occurring between the desired angular value and the detected (actual) angular value are not corrected for each angular position, or at each instant by the angular position controller, but only, with the highest possible accuracy, at the instant of sheet transfer. Moreover, the previously known drive device is also intended to help to prevent the mechanical collision of the gripper paths in the case of sheet-guided cylinders.

The device of DE 4 137 979 Al places exceptional demands on the production and signaling accuracy of the sensor for determining the angle of rotation in conjunction with the rotating part on which the said sensor is mounted. Even the very slightest alignment error of the sensor or the rotor of this sensor with respect to the rotating part (i.e., the cylinder) coupled to it therefore causes a systematic and periodically repeating deviation of the actual angular value from the angular value supplied by the sensor. In this device, severe and periodically repeating fluctuations occur during each revolution of the cylinders in printing units of sheet-fed offset printing presses. These fluctuations are caused by gaps of the printing unit cylinders rolling against one another. Furthermore, in printing units of sheet-fed offset printing presses, compressible blankets are selected for use depending on various printing conditions, with the result that the drive or drives are subjected to differing drive torques. Additionally, the stickiness of ink printed in an offset printing unit produces large forces and increased drive torques, such that the drive power required is strongly affected by the printing form print area or by the print area proportion.

All of these factors must be considered in order to achieve the desired accuracy of synchronism among the cylinders. The influences are not taken into account or appropriately compensated in the device of DE 4 137 979 Al.

German Patent Publication DE 4 214 394 Al discloses a web-fed rotary press which has a number of individually driven cylinders and at least one separately driven folding unit. The individual drives of the cylinders and the drive controllers thereof are combined into press groups, all of which draw a positional reference from the folding unit. The press groups are managed by a higher-order control system (e.g. an electronic longitudinal shaft). Since this reference relates only to a drive system for a web-fed rotary press, the synchronism problems specific to sheet-fed offset printing presses are not addressed and are not solved. For example, this reference naturally does not address the problem of a so-called mechanical gripper collision which exists in sheet-fed arrangements but which does not exist in web-fed rotary presses. Additionally, the cylinders (e.g., plate, blanket and impression cylinders) in the printing unit of a web offset printing press have only very narrow cylinder gaps. Because the pronounced torque fluctuations occurring in sheet-fed offset printing presses do not occur when printing unit cylinders roll against one another, only very slight interference effects occur in a web-fed press.

OBJECTS AND SUMMARY OF THE INVENTION

It is, therefore, an object of the present invention to provide an improved drive for a sheet-fed offset printing press which avoids the aforementioned disadvantages and accounts for the aforementioned parameters. Related objects are to facilitate highly precise synchronization among individually driven cylinders or cylinder groups, and to provide an improved drive which is flexibly adaptable to various printing conditions.

By means of the present invention, these objects are achieved and an improved drive is provided which facilitates precise control, error correction, and synchronization.

To this end, according the invention, a correcting device is provided for correcting or modifying a measured rotational position signal, this modified signal being provided to a drive controller instead of the directly measured signal. The drive controller includes a detecting device and a power section which controls a motor. The motor is mechanically coupled to the drive a printing unit cylinder to move corresponding to a prescribed desired position value. According to the invention, the correcting device translates the measured position values supplied by an angle position sensor (position of the cylinder) into modified values which are stored or which can be calculated as a function of the measured position values.

Various preferred embodiments of the correcting device are provided. For example, the correcting device may include a storage device containing a table which provides a predetermined modified value which corresponds to a given measured signal value. Alternatively, the correcting device may include a processing unit which applies a function to said measured signal to yield a corresponding said modified value.

In an embodiment wherein the correcting device includes a storage device, the storage device may store appropriately modified position values which correspond in tabular form to particular measured position values read in via the angle position sensor. The stored modified value is then relayed directly to the drive controller for the purpose of position control. The drive controller then controls the position of the cylinder or motor by sending appropriate control signals to the power section in conjunction with the desired position values, which are prescribed, for example, by a higher-order controller. The drive controller thus carries out the desired/measured comparison with the aid of the measured position values (but which have been modified by the correcting device), in conjunction with a prescribed desired position value. Based on these inputs, the controller forms the required control signals from which the power section (electronic drive) then appropriately provides power to the motor, which is drivably coupled to the cylinder.

In order to compensate for speed-dependent deviations, an embodiment of the invention provides that the rotational speed of the cylinder is sensed and fed to the correction device in addition to the position value. Based on a specific speed-dependent characteristic, a different correction value may be applied by the correction device in determining the modified position value as a function of the measured position values and particular cylinder speed values. This permits compensation for speed-dependent delays between the instantaneous actual position value of the angle position sensor, which can be read in, and the actual angle position value of the cylinder. These delays of corresponding signals may be due, for example, to dead times in the angle position sensor, or to other processing delays of the corresponding signals. Thus, for low rotational speeds, a different correction or modification of the measured position values is undertaken than for higher rotational speeds.

As mentioned above, the invention provides a correcting device, containing, for example, an offset table for modifying the measured position values supplied by the angle position sensor. In accordance with the resolution of the angle position sensor, i.e., the angular increments by which the measured position values can be detected, it is possible to determine path deviations which are repeated during each revolution. For example, during one revolution of the cylinder, the motor might lead or lag behind the cylinder particular manner. Also, at particular positions during a revolution, the cylinder may exert a defined slip over the printing zone with respect to a cooperating cylinder adjacent cylinder (e.g., the plate cylinder/blanket cylinder or blanket cylinder/impression cylinder). The invention allows compensation of printing length compensations to a desired degree. The necessary angle correction values are stored in the offset table of the correcting device such as to produce a homogeneous, or steady, concentricity, so that a modification is undertaken with the same correction value after each full revolution.

The invention can also be used for specific printing compensations. Of particular concern is "printing length compensation". In conventionally driven cylinders printing length compensation is undertaken by under laying packing sheets of appropriate thickness below the printing plate and/or the blanket. In an offset printing unit having a blanket cylinder and/or plate cylinder which is driven individually it is possible to achieve the same effect as using packing sheets of various thicknesses, by storing appropriate angle position correction values in the correcting device offset table to drive the plate cylinder in a desired relation to the blanket cylinder. Where the printing zones of the two cylinders correspond to one another and roll on one another, the plate cylinder exerts a leading effect or lagging effect with respect to the blanket cylinder. Because of resulting slip, the printing image transferred onto the blanket cylinder is printed for a correspondingly longer or shorter time. The correction values stored in the offset table of the correcting device are tuned to one another, in this embodiment, such that the leading or lagging of the mutually cooperating cylinders (blanket cylinder/plate cylinder) is canceled out again during the gap in correspondence, and the leading or lagging cylinder again assumes the same starting position, such as at the nominal start of printing.

According to an embodiment of this invention, in addition to printing length compensation, it is also possible to simulate different compressibilities or printing properties of blankets by appropriate modification of the offset table of the correcting device. Because ghosting is also caused in the region of the printing zone between the plate cylinder and blanket cylinder, or in the region between the blanket cylinder and impression cylinder, or printing carrier, this effect can also be opposed by appropriate modification of an offset table, prescribed only once, or by appropriate selection from a multiplicity of stored offset tables.

In addition to the possibilities for applying the invention to achieve compensation during printing, the present invention provides advantages in that the mounting and manufacture of the drive system may be performed with relatively low tolerances and precision. For example, the need for a top-quality angle measuring system is eliminated, and less expensive, lower-quality sensors can be used as a result of the invention. The inaccuracies of drive elements connected between the cylinder and its associated drive motor can be compensated by the correcting device according to an embodiment of the invention. Furthermore, expensive fine adjustment of the measuring system (e.g., angle position sensor) can be eliminated. Instead, a correction function is determined by means of a comparative measurement of the sensor by using a high-precision position sensor employed during assembly, something which produces compensation via the offset table provided and the controller.

Other objects and advantages of the invention will become apparent upon reading the following detailed description and upon reference to the drawings, in which:

Figure 1:
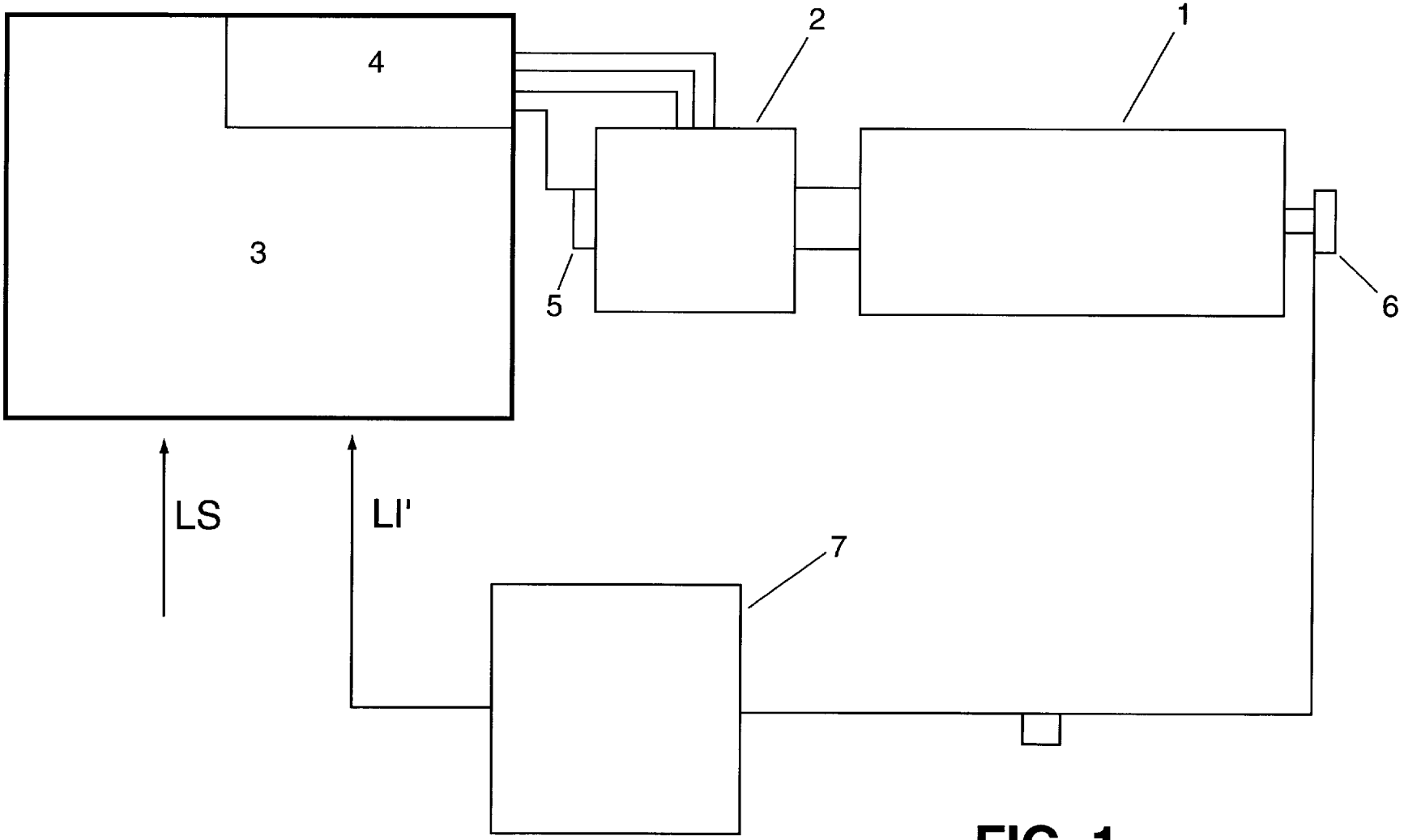
FIG. 1 is a diagrammatic view of a drive unit for a printing unit cylinder with a drive controller having the correcting device provided according to the invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalence falling within the spirit and scope of the invention.

DETAILED DESCRIPTION OF THE DRAWINGS

Referring now more particularly to the drawings, in FIG. 1 there are shown the components for an individual drive of a cylinder 1 in the printing unit of a sheet-fed offset printing press. In this case, the cylinder 1 can be, for example, a plate cylinder, a blanket cylinder or an impression cylinder. The cylinder 1 is operably coupled to a motor 2, by which the cylinder 1 can be driven. Rotatably coupled to the cylinder 1 is an angle position sensor 6 in the form of an absolute angle sensor, providing a signal corresponding to the angle position of the cylinder 1.

Figure 8:
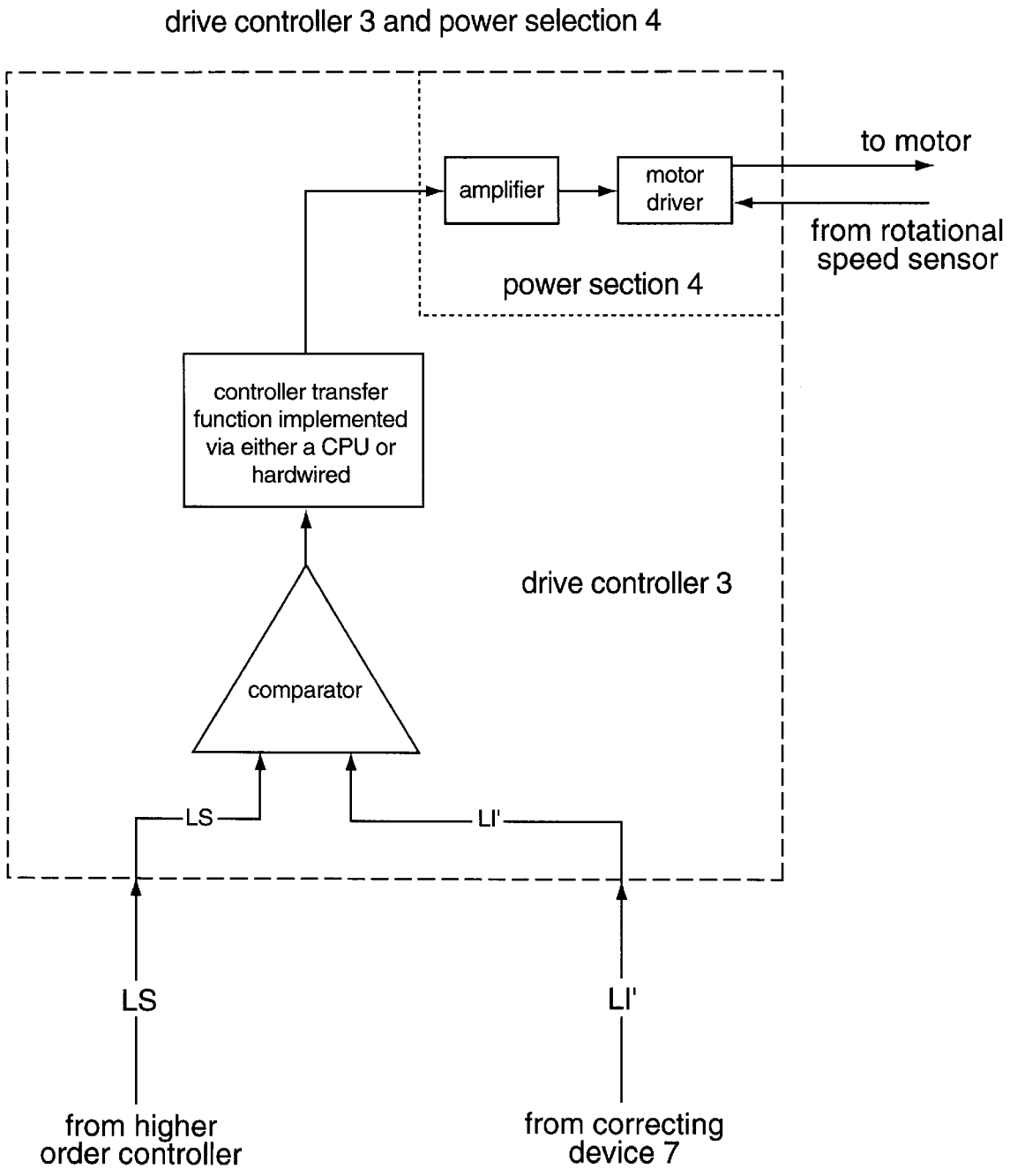
FIG. 8 is a diagrammatic view of the drive controller and the power unit with a control logic and a means for sending signals to the motor.

A drive controller 3 is preferably an electronic control device and is connected to deliver signals to a converter or power section 4. In turn, the power section 4 is operable to variably provide the motor 2 with power. An embodiment of the drive controller 3 and power section 4 is shown in FIG. 8. The motor 2, preferably a brushless DC motor, is connected to a commutation sensor 5. The commutation device forms commutation signals and provides the motor 2 with the power in the correct position by means of the power section 4. Via a signal line indicated in FIG. 1, the drive controller 3 receives desired position values LS from a higher-order controller (not shown). For example, such a higher-order controller is disclosed in U.S. Ser. No. 08/872,693 (Filed Jun. 11, 1997, Attorney Docket No. 78644, Entitled "Drive for a Printing Machine", Inventors: Albrecht Volz; Jachim Blumor; Hoger Wiese; Klaus-Peter Reichardt; and Helmut Schild), incorporated herein by reference.

According to the invention, actual measured position values of the cylinder are delivered to a correcting device which corrects or translates the measured value into a modified position value which is sent to the controller. This correction of the measured value facilitates the compensation for known or determinable parameters effecting mechanical deviations in the drive, providing precise driving control in the presence of various errors in the printing drive. In the particular embodiment illustrated in FIG. 1, actual position values or angle signals LI from the angle position sensor 6 of the cylinder 1 are delivered to a correcting device 7.

In keeping with the invention, various embodiments of the correcting device 7 are possible for converting a measured position value LI (received from the position sensor 6) into a modified position value LI'. For example, the correcting device 7 can include a storage device, described in greater detail below in connection with FIG. 3. Additionally, the correcting device 7 can include a processing unit, described in greater detail below in connection with FIG. 4.

As shown in FIG. 1, the correction device 7 is connected downstream of the angle position sensor 6 and upstream of the drive controller 3. Regardless of whether the correction device 7 is a storage device (FIG. 3) or a computing device (FIG. 4), it is possible to determine systematic positional deviations set up during installation of the system (e.g., mounting the angle position sensor on the appropriate cylinder) and to undertake appropriate corrections to compensate these errors. Notably, correctable deviations include those caused by radial eccentricities or positional errors produced when the angle sensor rotor does not run exactly coaxially with the cylinder (e.g., wobbling movements). The correcting device can also be used to detect and compensate systematic angle position deviations caused by the measuring principle of the angle position sensor.

In operation, the modified position value LI' from the correcting device 7 is fed to the drive controller 3, which performs an evaluation in accordance with a desired/measured comparison for the purpose of controlling the position of cylinder 1. More specifically, the drive controller 3 undertakes the desired/measured comparison with the desired position value LS prescribed by the higher-order controller not directly with the measured position values LI received from the angle position sensor 6, but rather with the modified position values LI'.

Figure 3:
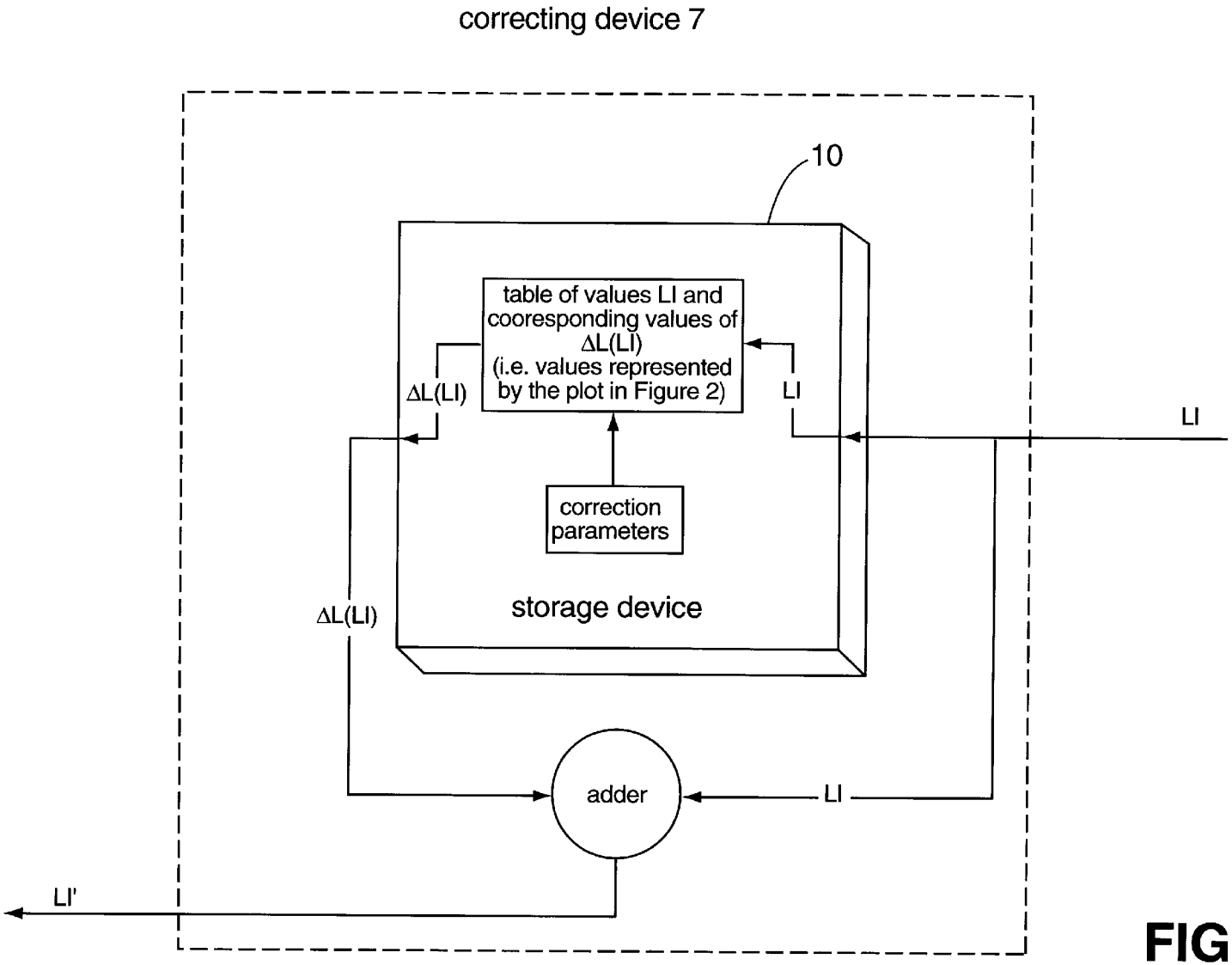
FIG. 3 is a diagrammatic view of the correcting device implemented through a table of measured position values and modified position values.

According to an embodiment of the invention as illustrated in FIG. 3, the correcting device 7 includes a storage device 10. Modified position values LI' are generated in the correcting device 7 from the measured position values LI (detected by the angle position sensor 6), in conjunction with corresponding correction values ΔL stored in the storage device 10. The modified position values LI' are arrived at according to the following relationship:

$$LI' = LI + \Delta L(LI).$$

The modified position values LI' are generated from the measured position values LI and a correction variable ΔL(LI). The correction variable ΔL(LI) can be positive or negative, with the effect that the measured position value LI currently supplied by the angle position sensor 6 is increased or decreased by a corresponding amount.

Figure 2:
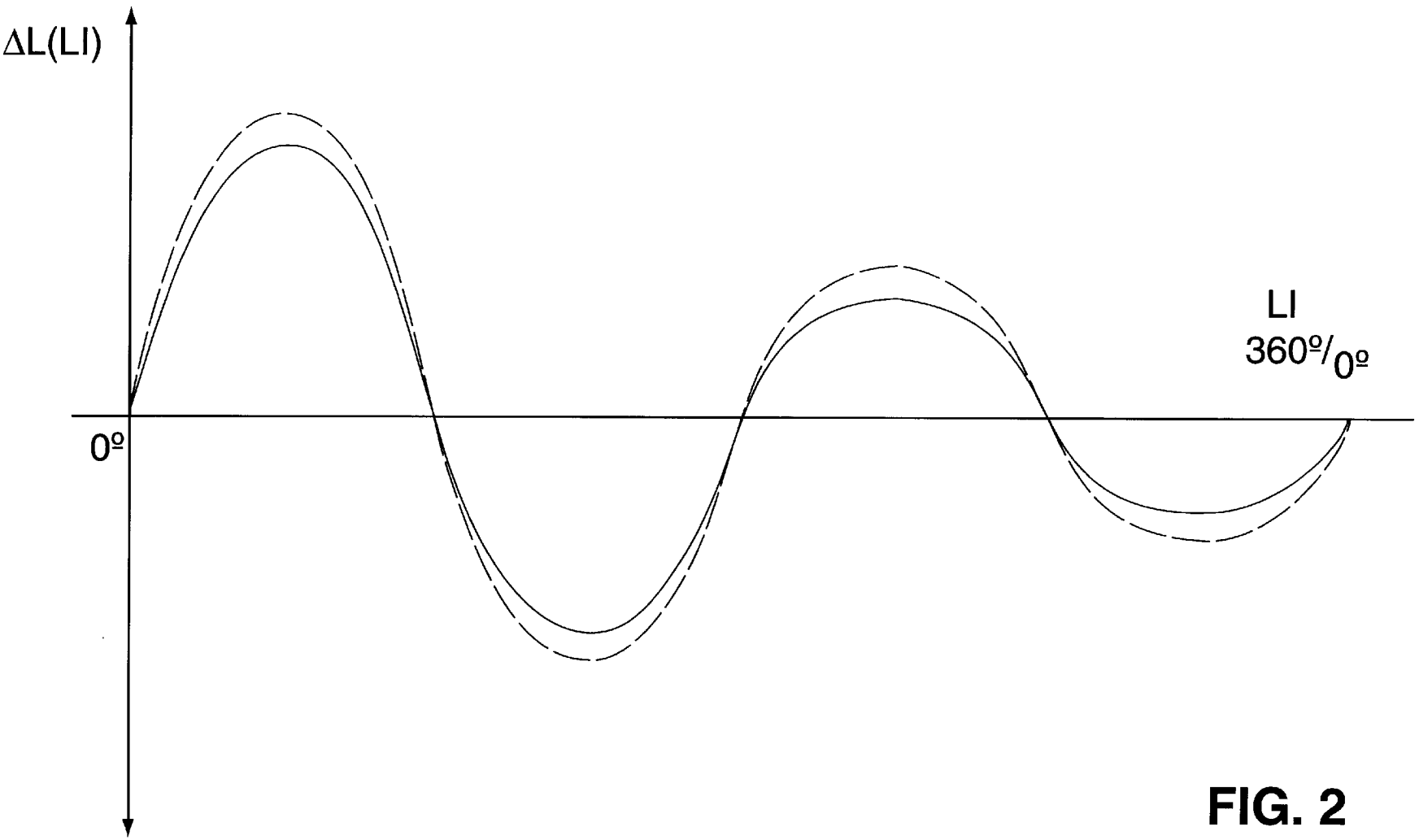
FIG. 2 is a chart of the correction values plotted as a characteristic per revolution, the correction values being applied in modifying the measured position values sensed by the angle position sensor.

In the embodiment of FIG. 3, the correction values ΔL(LI) assigned to the individual measured position values LI are stored in an offset table in the storage device 10. In principle, the correction values are shown by the plot of FIG. 2 in the form of a characteristic. In FIG. 2, the current measured position value LI (detected from the angle position sensor) is plotted on the abscissa between 0° and 360°. The characteristic in accordance with FIG. 2 thus represents a reference to the correction value ΔL(LI), which can be read off on the ordinate and corresponds to the respective measured position value LI. The transition from 0° to 360°, or the transition from 360° to 0° (beyond one revolution) has a steady transition of the characteristic ΔL(LI).

As also shown in FIG. 2, it is additionally possible to modify a characteristic stored in the offset table. In FIG. 2, the characteristic indicated by a continuous line represents a so-called output characteristic, while the characteristic indicated in a dashed line represents a characteristic modified in accordance with prescribable parameters. In the example in accordance with FIG. 2, the output characteristic ΔL(LI) has been modified in this case through multiplication by a prescribed factor.

Figure 4:
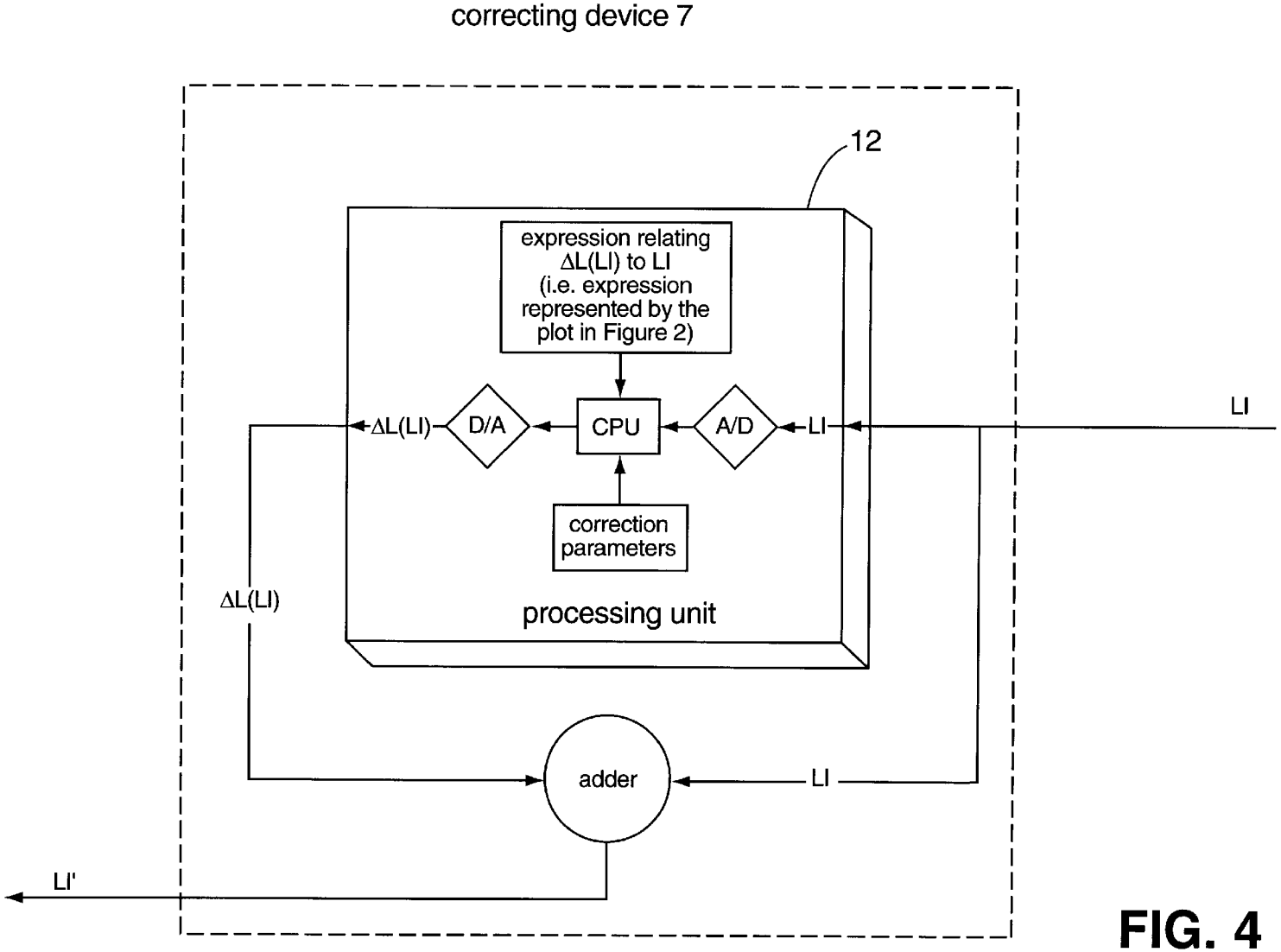
FIG. 4 is a diagrammatic view of the correcting device implemented by using a central processing unit which can modify the measured position values by specific factors over the entire angular range, or in angular sections.

Alternatively, as illustrated in FIG. 4, the correcting device 7 includes a processing unit 12, is shown in FIG. 4. The processing unit can be used to modify the measured position values from the angle position sensor by specific factors over the entire angular range or in angular sections. For example, the measured position values may be increased or decreased within specific angle position ranges through multiplication by an appropriate, stored factor.

Figure 5:
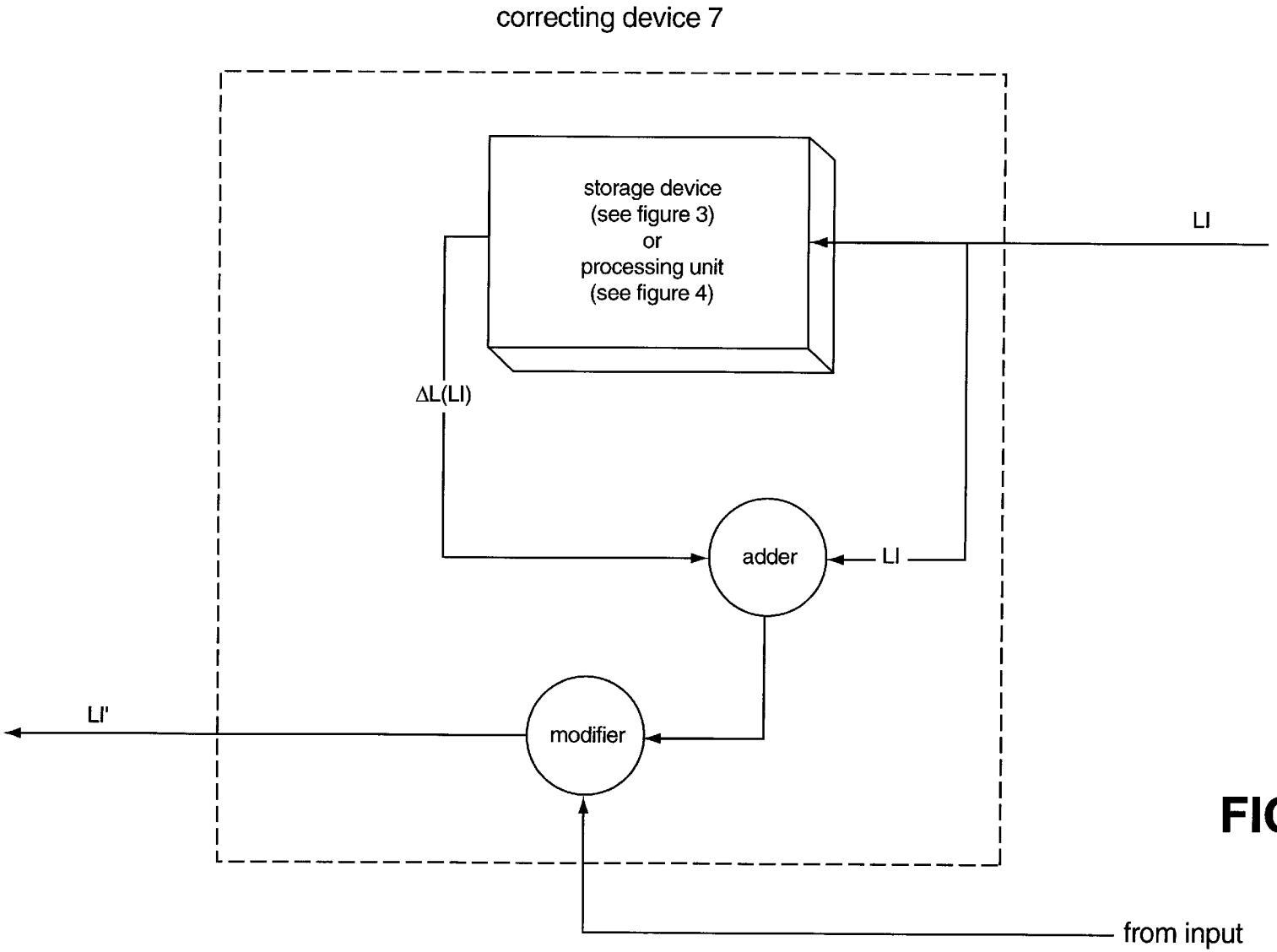
FIG. 5 is a diagrammatic view of the correcting device in an embodiment which allows for a user input.

According to another embodiment of the invention, the modified position values LI' are generated in the correcting device 7 in conjunction with a user defined input. The user input can be used to fine tune the system after manufacture and mounting, and user input can also be used for specific printing compensations, such as a manual printing length compensation. An implementation of the correcting device 7 allowing for user input is shown in FIG. 5, wherein the modified signal LI' is generated is modified by the user-inputted signal.

Figure 6:
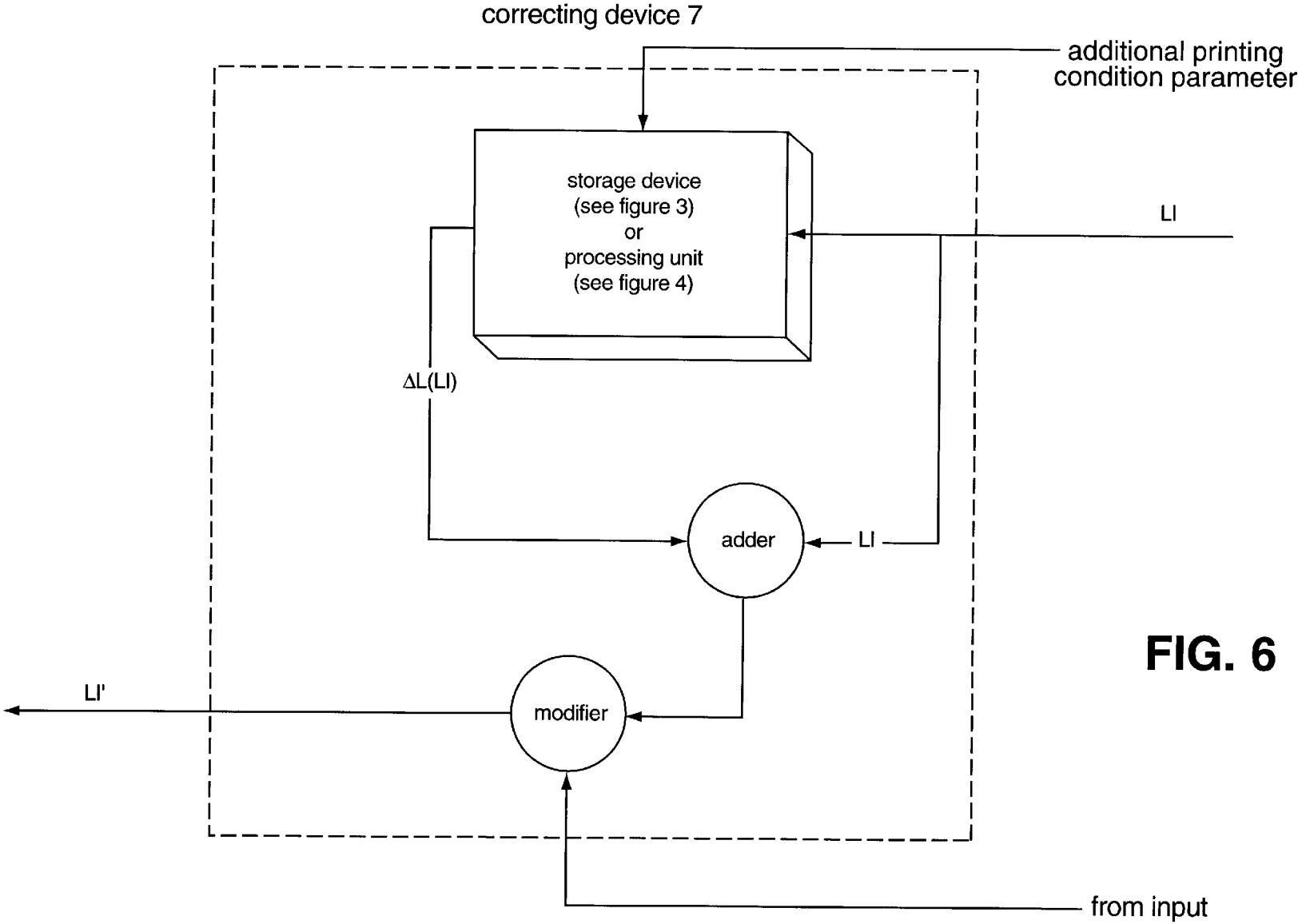
FIG. 6 is a diagrammatic view of the correcting device in an embodiment which allows for a user input and for the input of additional parameters from the printing unit.

A further embodiment calls for the generation of modified position values LI' in conjunction with a user defined input and other inputs relating to various printing conditions. The input of printing conditions can automate compensation such as printing length compensation or the simulation of different compressibilities. An implementation of the correcting device 7 allowing for user input and additional inputs for printing conditions is shown in FIG. 6, wherein the additional printing condition parameter input is considered in determing the modified value LI'.

Figure 7:
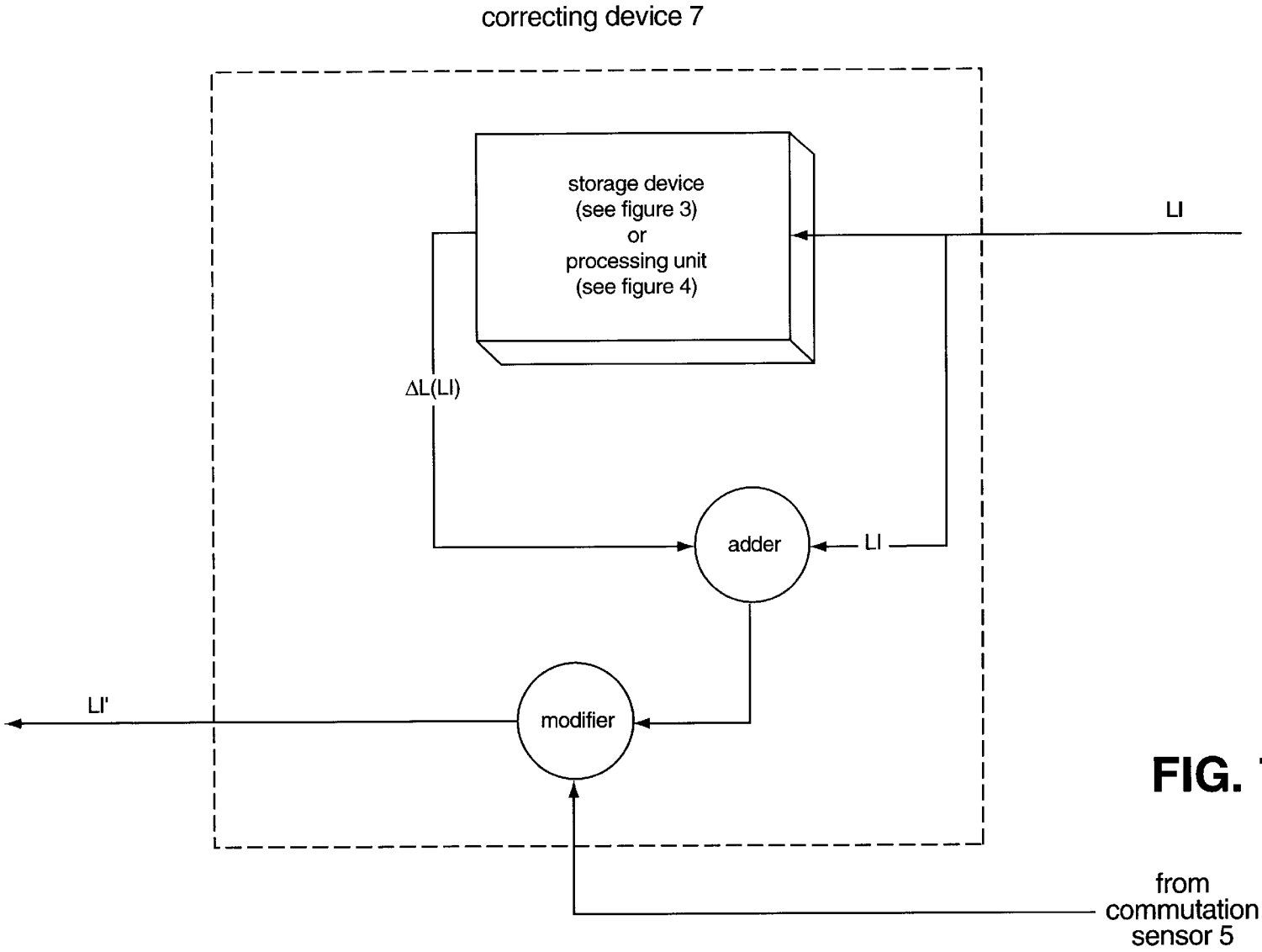
FIG. 7 is a diagrammatic view of the correcting device in an embodiment which allows for speed-dependent correction through the input of the rotational speed of the cylinder as sensed by a commutation sensor.

Another embodiment of the invention allows for the compensation of speed-dependent deviations. In such an embodiment, the sensor 6 also senses rotational speed of the cylinder 1. The correcting device 7 then may apply different correction values to compensate for speed-dependent delays between the angle position sensor and the actual angle position value. FIG. 7 illustrates such an embodiment, wherein a signal from the commutation sensor is input to the correcting device 7.

What is claimed is:

1. A drive for a printing press comprising: at least one rotatable printing cylinder; a motor coupled to the cylinder to rotatably drive the cylinder; an angle position sensor adapted to measure the angular position of the cylinder; a drive controller controlling the motor; and a correcting device connected to receive measured position values from the position sensor, the correcting device converting measured position values into modified position values to compensate for errors in the measured position values; wherein the drive controller is connected to receive the modified position values from the correcting device, the drive controller comparing the desired position values with the modified position value and actuating the motor in response to the comparison to compensate for any deviation between the desired position value and the modified position value.

2. The drive of claim 1 wherein said correcting device includes a storage device storing said modified position values corresponding to specific measured position values, the storage device being connected to the drive controller to deliver the modified position values to the drive controller.

3. The drive of claim 1 wherein the correcting device calculates said modified position values from said measured position values.

4. The drive of claim 1, further comprising an input device operable to change the modified position values, and to feed the said modified position values to the drive controller as a function of the respective measured position values.

5. The drive of claim 4, wherein said correcting device also changes said modified position values as a function of additional printing condition parameters from said input device.

6. The drive of claim 1, further comprising a rotational speed sensor to detect a rotational speed of the cylinder and send a corresponding signal to said correcting device, and wherein said correcting device determines said modified position values as a function of the rotational speed signal.

7. A drive for printing unit cylinder comprising: a motor drivably coupled to the printing unit cylinder for rotating the printing unit cylinder; a sensor measuring a rotational position of the printing unit cylinder and providing a corresponding measured signal; a correcting device receiving the measured signal from the sensor and translating the measured signal into a modified signal to compensate for errors in the measured signal; and a drive controller for adjustably controlling the motor in response to the modified signal considered in conjunction with a desired input.

8. The drive according to claim 7, wherein the correcting device includes a storage device containing a table which includes said modified value corresponding to a given said measured signal.

9. The drive according to claim 7 wherein said correcting device includes a processing unit which applies a function to said measured signal to yield a corresponding said modified value.

* * * * *